United States Patent [19]

Servadio

[11] 4,291,429

[45] Sep. 29, 1981

[54] DRILL ATTACHMENT

[76] Inventor: Robert Servadio, 3721 Parkview Ave., Pittsburgh, Pa. 15213

[21] Appl. No.: 81,577

[22] Filed: Oct. 3, 1979

[51] Int. Cl.[3] ..... B08B 9/02

[52] U.S. Cl. ..... 15/104.3 SN

[58] Field of Search ..... 15/104.3 R, 104.3 SN

[56] References Cited

U.S. PATENT DOCUMENTS

| | | | |
|---|---|---|---|
| 2,033,670 | 3/1936 | Auer | 15/104.3 SN |
| 2,201,733 | 5/1940 | Kollmann | 15/104.3 SN |
| 2,467,849 | 4/1949 | O'Brien et al. | 15/104.3 SN |
| 2,617,135 | 11/1952 | Larsen | 15/104.3 SN |
| 4,067,248 | 1/1978 | Lavagetto | 15/104.3 SN X |

*Primary Examiner*—Edward L. Roberts

*Attorney, Agent, or Firm*—William J. Ruano

[57] ABSTRACT

A drill attachment for driving and guiding a snake or eel used for unclogging stopped up drain pipes. The attachment is fastened to the body of a conventional electric drill and includes a guide tube, part of which is flexible for leading an eel or snake through a chuck which is attached to a leading portion of the eel. A reduction gear is interposed between the drill shaft and the chuck so as to drive the chuck and eel at reduced speeds. The attachment converts an electric drill into a highly useful household "do it yourself" device for unclogging kitchen and bathroom sinks and drains.

2 Claims, 2 Drawing Figures

DRILL ATTACHMENT

Figures 1, 2:
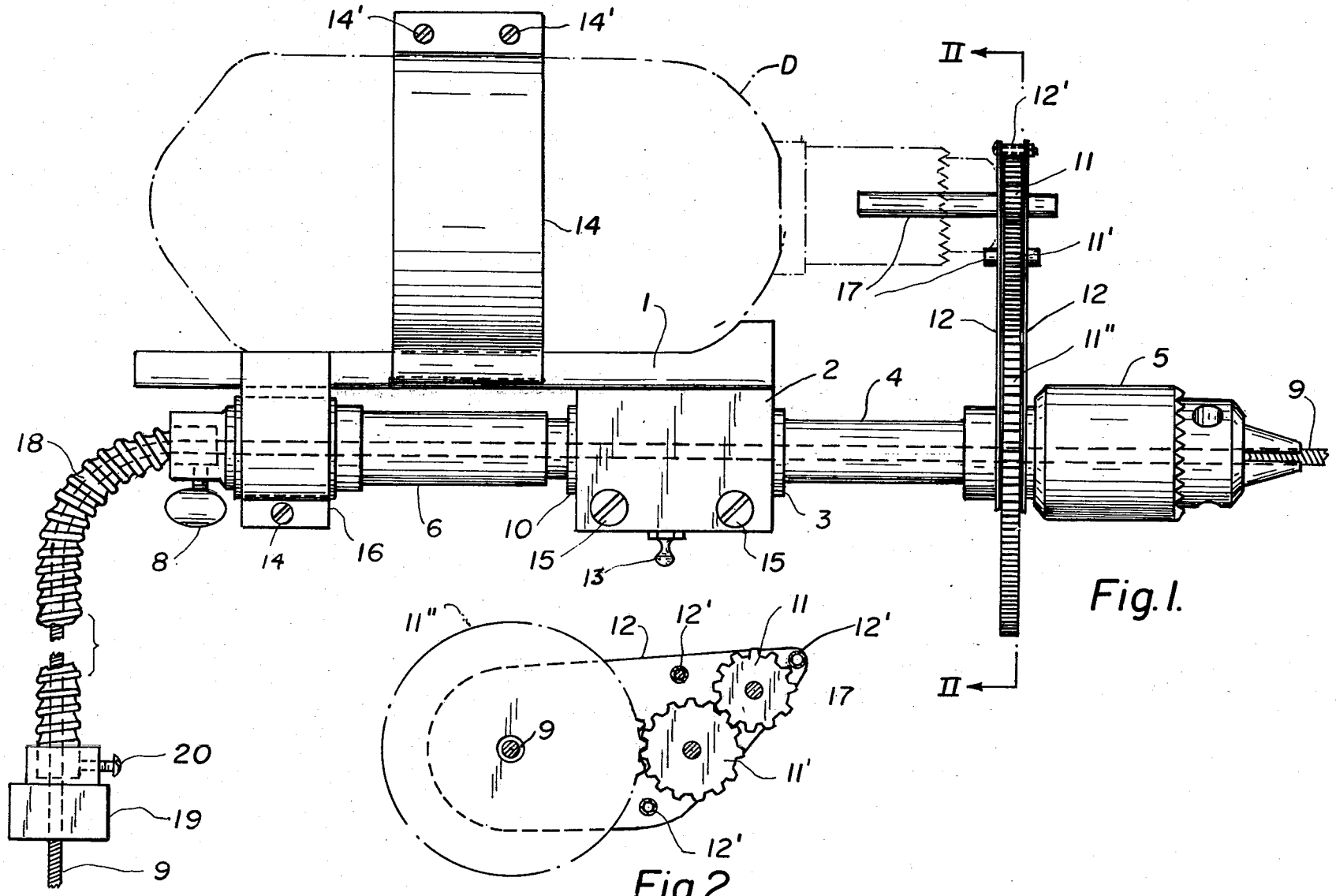

This invention relates to an attachment for an electric drill to enable the drill to drive an eel or snake at reduced speeds for the purpose of clearing clogged drain pipes.

An outstanding disadvantage of the use of chemicals for unclogging stopped sink and bathroom drain pipes has been that they are not often effective. If it were attempted to use an eel or snake and operate it manually, such unclogging would be a laborious task requiring a long period of time to clear the debris clogging the drain pipe.

An object of my invention is to provide a novel attachment for an electric hand drill to enable the drill to exert the driving force for an eel or a snake and for guiding it properly into a clogged drain pipe of a sink, bathroom or the like.

Another object of my invention is to provide a "do it yourself" machine comprising an electric hand drill and a novel attachment to enable any householder to easily and quickly open up a stopped sink or drain without calling a plumber.

A more specific object of my invention is to provide an attachment of relatively simple construction for enabling reduction in speed of the driven shaft of the drill to enable its use for driving the snake at lower speeds and for providing guiding and holding means for the snake while it is being driven into the clogged pipe.

Other objects and advantages of the invention will become more apparent from a study of the following description taken with the accompanying drawing wherein:

FIG. 1 is an elevational view of a drill attachment embodying the present invention; and FIG. 2 is a fragmentary side view, as viewed from the right of FIG. 1, showing the reduction gear train.

Briefly stated, the invention comprises an attachment including a unique arrangement comprising guiding means for guiding a snake or eel, a chuck for holding the eel, and a reduction gear for reducing the driving speed of the eel to substantially less than that of the drill.

Referring more particularly to FIGS. 1 and 2 of the drawing, numeral 1 denotes a frame suspended from drill D by a pair of arcuate clamps 14 held together at the top by bolts 14'–14 of an attachment comprising a mounting block 2 having shaft bushings 3, 10 surrounding a central portion of hollow rotatable shaft 4 for conveying an eel or snake 9 of helically wound wire. The rear portion of shaft 4 is rotatably supported by a hollow non-rotatable tube 6 mounted on frame 1 by adapter cradle 16.

The forward portion of snake 9 is firmly held by a chuck 5 which is driven by a gear 11'' which is in mesh with gears 11' and 11, as shown more clearly in FIG. 2. The reduction gear described is for the purpose of reducing the driven speed of chuck 5 and snake 9 to considerably lower than the speed of the driven shaft 17 in the drill chuck of the electric drill D, only the housing of which is partly shown in dash and dot outline. The speed may be reduced as much as 1/20 of the drill speed.

A flexible conduit 18 is held, at one end, by a wing nut 8 to secure it to hollow tube 6. At the other end of the conduit 18, a weight 19 is provided, fastened to the conduit by screw 20 or other suitable fastening means to prevent the snake or eel from violent turning movements tending to make it difficult to control the forward movement of the snake. A snap ring is secured to part 10 (not shown). Numerals 12 denote a gear case for mounting bolts and spacers.

A grease fitting 13 is provided, as well as block bolts 15 on the mounting block 2.

In operation, as the electric drill drives its drive shaft 17, it will rotate its chuck and a gear 11 which drives gear 11' and, in turn gear 11'' of larger diameter thus rotating chuck 5 and the forward end of eel or snake 9 at reduced speed while the latter is being guided into a drain which has been clogged-up.

After a predetermined rotation of the snake, the electric drill is stopped and the chuck reset to enable the snake to be moved to the right, as viewed in FIG. 1, and clamped again in a new position by the chuck so that a longer portion may be fed into the clogged drain pipe. Thereafter, the electric drill is restarted to again drive snake 9 at reduced speeds or perhaps as much as 1/20 of the drill speed.

The attachment involving the present invention is made of standard and inexpensive parts which can be easily and quickly assembled and which effectively guides the snake into the guiding hollow tube 6 and shaft 4, thence to chuck 5. By the present invention, operating a snake in a clogged drain is a relatively easy task involving no manual effort and greatly speeds the time required for clearing a clogged drain. It enables persons with little skill to quickly unclog a stopped-up drain without the necessity of calling a plumber.

Thus it will be seen that I have devised a highly efficient attachment that can be easily and quickly attached to a conventional electric drill to convert it to a drive for an eel or snake for unclogging a drain pipe.

While I have illustrated and described a single embodiment of my invention, it will be understood that this is by way of illustration only and that various changes and modifications may be contemplated in my invention and within the scope of the following claims.

I claim:

1. In combination with an electric hand drill having a housing with a chuck at the forward end of said housing, an attachment comprising a frame located directly at a side of said housing, a clamp attached to said frame and surrounding said housing for attaching said frame to said housing, means rotatably supporting a hollow shaft from said frame with said hollow shaft extending parallel to the axis of said drill, said supporting means including means rotatably supporting a rearward portion of said hollow shaft, a chuck mounted on the forward end of said hollow shaft adjacent to said drill chuck, a gear having a shaft mounted in said drill chuck, a gear support means mounted between said gear and said hollow shaft, reduction gear means mounted on said gear support means between said gear and said hollow shaft chuck to drive said hollow shaft chuck at a considerably reduced speed and in the same direction as said gear shaft, a snake extending through said hollow shaft so that a forward portion of said snake is clamped by said hollow shaft chuck, and a flexible conduit attached to the means supporting the rearward portion of said hollow shaft, whereby said snake is fed through said flexible conduit and hollow shaft and rotated at a slow speed to enable unclogging of a drain.

2. The combination recited in claim 1 together with a weight attached to the free end of said flexible conduit.

* * * * *